US009737185B2

(12) United States Patent
Stein et al.

(10) Patent No.: US 9,737,185 B2
(45) Date of Patent: Aug. 22, 2017

(54) FLOOR CARE APPLIANCE

(71) Applicant: Stein & Co. GmbH, Velbert (DE)

(72) Inventors: Thomas Stein, Velbert (DE); Hartmut Boll, Velbert (DE)

(73) Assignee: STEIN & CO. GmbH, Velbert (DE)

( * ) Notice: Subject to any disclaimer, the term of this patent is extended or adjusted under 35 U.S.C. 154(b) by 94 days.

(21) Appl. No.: 14/704,015

(22) Filed: May 5, 2015

(65) Prior Publication Data

US 2015/0320276 A1 Nov. 12, 2015

(30) Foreign Application Priority Data

May 6, 2014 (DE) ..... 10 2014 006 676
Jul. 5, 2014 (DE) ..... 10 2014 010 099

(51) Int. Cl.
*A47L 5/30* (2006.01)
*A47L 9/04* (2006.01)
*A47L 9/28* (2006.01)

(52) U.S. Cl.
CPC ..... *A47L 9/0411* (2013.01); *A47L 9/0427* (2013.01); *A47L 9/0444* (2013.01); *A47L 9/2831* (2013.01); *A47L 9/2847* (2013.01); *A47L 9/2857* (2013.01); *A47L 9/2889* (2013.01)

(58) Field of Classification Search
CPC .... A47L 9/0411; A47L 9/0444; A47L 9/2847; A47L 9/2889; A47L 9/2831; A47L 9/2857
See application file for complete search history.

(56) References Cited

U.S. PATENT DOCUMENTS

| | | | |
|---|---|---|---|
| 4,099,291 | A | 7/1978 | Bowerman |
| 4,728,942 | A | 3/1988 | England |
| 5,056,175 | A | 10/1991 | Stein |
| 2010/0242224 | A1 | 9/2010 | Maguire |

FOREIGN PATENT DOCUMENTS

| | | |
|---|---|---|
| DE | 3913390 | 10/1990 |

OTHER PUBLICATIONS

EP Search Report for corresponding EP Application No. 15 16 6366, dated Oct. 5, 2015.

*Primary Examiner* — David Redding
(74) *Attorney, Agent, or Firm* — Greer Burns & Crain, Ltd.

(57) ABSTRACT

A brush vacuum cleaner having a floor brush set with a driven brush roller having an overload protection. The brush set has at least one electric motor for a suction fan and for the drive of the brush roller, which includes a torque detecting unit. A safety shutdown is accomplished via a switch arrangement above an overload torque threshold. A driven element of the torque detection unit is disposed in the drive train which, above the torque threshold, is coupled via a switchable coupling element to an eddy current disk made of electrically conductive material. The eddy current disk has at least one magnet pivotably positioned on a fixedly mounted movable support. An adjustment of the support is made by a magnetic field of the coupled eddy current disk formed by the generated eddy current. The support controls a corresponding circuit arrangement such as a switching element as safety cut-off.

10 Claims, 5 Drawing Sheets

FLOOR CARE APPLIANCE

CROSS-REFERENCES TO RELATED APPLICATIONS

This application claims the benefit of the German patent application No. 10 2014 010 099.5 filed on Jul. 5, 2014, and of the German patent application No. 10 2014 006 676.2 filed on May 6, 2014, the entire disclosures of which are incorporated herein by way of reference.

BACKGROUND OF THE INVENTION

The invention relates to a floor care appliance in the form of a brush vacuum cleaner having a brush set facing the floor for receiving a driven brush roller with an overload protection, where the brush set can be connected by means of a pivotable connecting element in the form of a connecting piece for an attachable filter housing to a handle in the form of a hand grip via corresponding connections and where the brush set has at least one electric motor for a suction fan and for the drive of the brush roller, where the brush roller is assigned a unit for detecting the torque and a safety shutdown is accomplished by means of a switch arrangement above a torque threshold due to overload.

It is known to configure safety devices for brush vacuum cleaners which carry out a mechanical or electronic decoupling in the event of overload and blocking of the driven brush roller. In this case it is provided either to perform an electronic shutdown by slippage of a non-positively arranged belt for driving by a built-in slip or ratchet coupling with a controller which monitors the power of the drive or to perform this by means of a torque measurement and evaluation by microcontrollers with subsequent electronically triggered shutdown of the electrical drive. In particular in devices having only one motor for fan and brush drive, this can only be solved in a very complex and cost-intensive manner in order to ensure a long stability and operating safety. In addition, there is the shortcoming that in addition to the controlled shutdown devices, an additional switch is always required as main switch and relatively high expenditure for electronic controls is given. A floor care appliance in which for example a height adjustment is accomplished automatically as a function of the torque is disclosed in the applicant's patent application DE 39 13 390 A1.

SUMMARY OF THE INVENTION

It is an object of the invention to improve an overload cut-off of a motor for generic brush vacuum cleaners and enable a simple mechanical detection of torque with an associated triggering mechanism and to ensure a good functionality.

This object is solved whereby a driven element of the unit for torque detection is disposed in the drive train which above the torque threshold can be coupled by means of a switchable coupling element to an associated body of rotation in the form of an eddy current disk made of electrically conductive material, and that the eddy current disk is assigned at least one magnet which is pivotably positioned on a fixedly mounted movable support, and an adjustment of the support is made by a magnetic field of the coupled eddy current disk formed by the generated eddy current, wherein the support controls a corresponding circuit arrangement such as a switching element as safety cut-off.

The use of an eddy current disk and an associated pivotable support with a magnet enables a simple switching mechanism which mechanically ensures a safety cut-off in the event of overload in a simple manner. In addition, this configuration enables time delays for the switching movement in order to compensate for torque peaks.

For shutting off the motor via the circuit arrangement it is provided that the circuit arrangement is configured as an electrical switch, reed contact, light curtain or mechanical spring-loaded switch.

It is further proposed that the driven element of the unit for torque detection assigns the connectable coupling element to the eddy current disk via a contact surface as a low-slippage connection.

An advantageous embodiment consists in that the magnet is disposed on the movable support at a distance from the eddy current disk and the magnetic field lines penetrate the side surfaces of the eddy current disk substantially perpendicularly.

Alternatively it is provided that the magnet comprises the eddy current disk in a contact-free manner as a yoke.

It is further provided that the eddy current disk is disposed concentrically by means of a central bearing for rotation and axial fixing on a shaft with the driven element and the coupling element.

A simple embodiment is created whereby the movable support is configured as a fixedly mounted pivotable lever, wherein the pivot path of the magnet via the lever runs approximately parallel to the plane of rotation of the eddy current disk.

It is furthermore advantageous that the movable support is configured as a fixedly mounted pivotable lever, wherein the pivot path of the magnet via the lever runs approximately at a distance from the external rotation path of the eddy current disk.

In order to prevent an unintentional switching process when impact stresses occur at the brush set, it is of particular importance that a pivotably arranged locking lever having a magnet assigned in a contact-free manner to the eddy current disk on a sub-arm of the locking lever is disposed on the pivotable lever as support, wherein the locking lever is pre-stressed on the pivotable lever by means of a spring element and the sub-arm is splayed out, and the splayed-out sub-arm of the locking lever in the pre-stressed starting position serves as a lock for the pivotable lever by means of a fixed stop and upon rotation of the eddy current disk by a magnetic field formed by the generated eddy current the locking lever via the magnet releases the locking effect by pivoting.

BRIEF DESCRIPTION OF THE DRAWINGS

An exemplary embodiment of the invention is shown schematically in the drawings. In the figures.

DETAILED DESCRIPTION OF THE PREFERRED EMBODIMENTS

Figure 1:
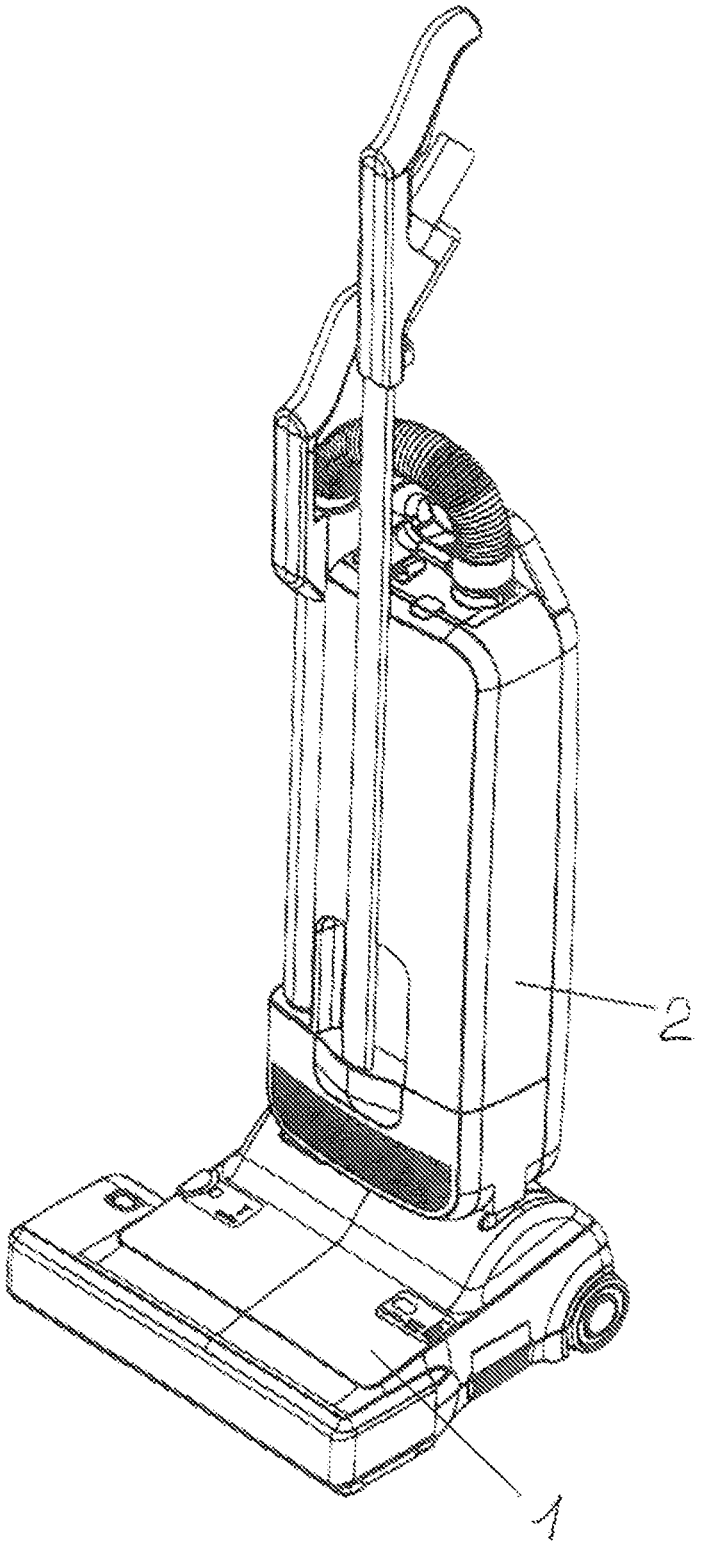
FIG. 1 shows a brush vacuum cleaner with a brush set and a filter housing placed thereon.
Figure 2:
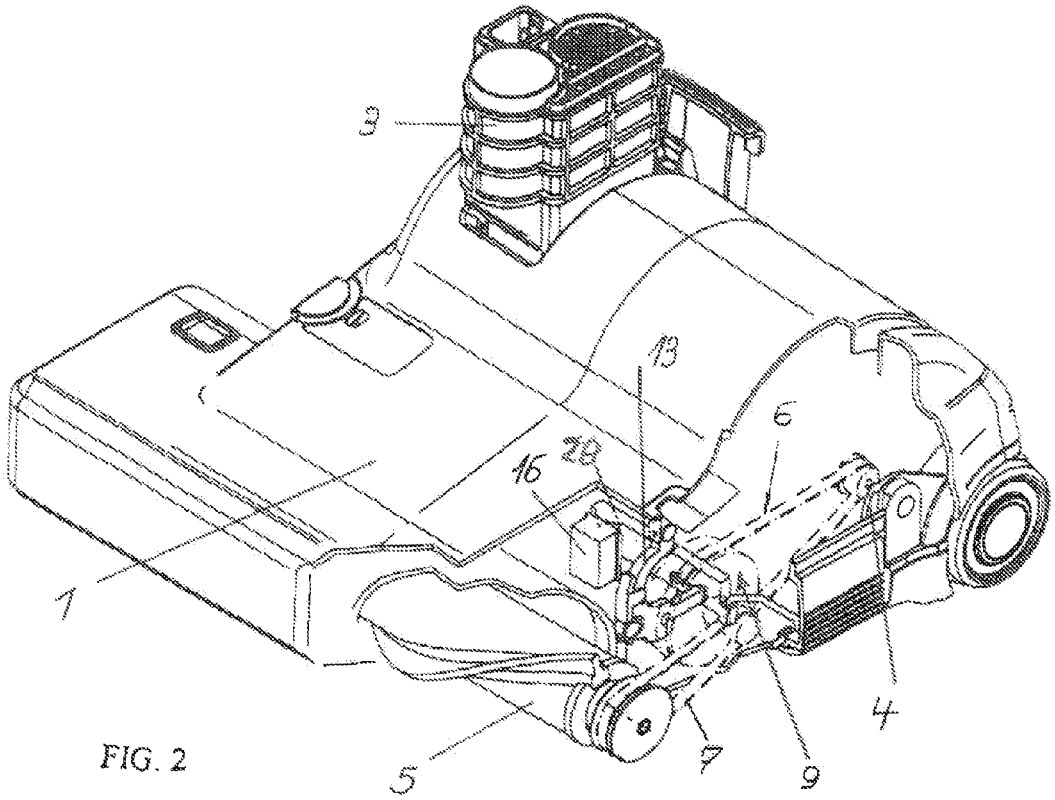
FIG. 2 shows a brush set in perspective view with a unit for torque detection and switching elements.
Figure 3:
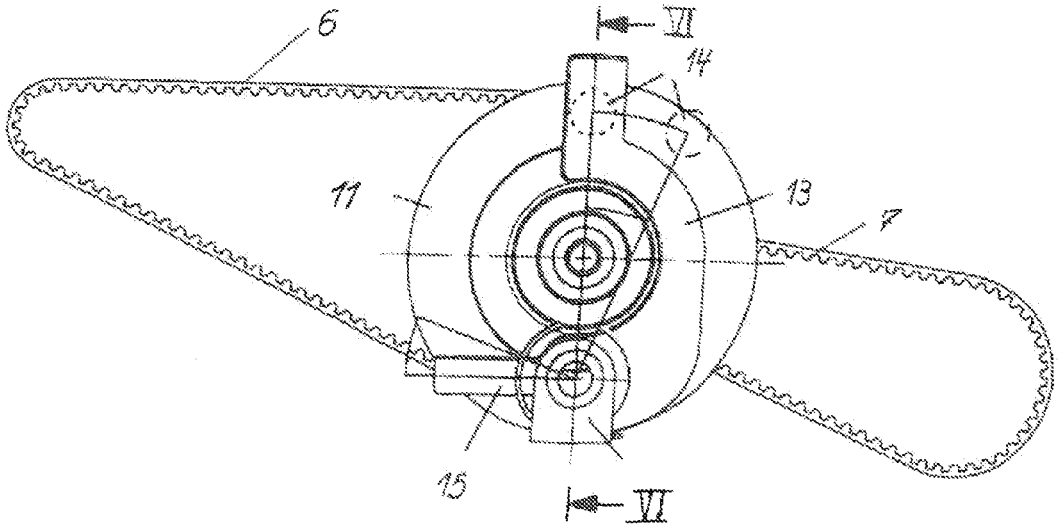
FIG. 3 shows a side view of an eddy current disk with associated pivotable lever.
Figure 4:
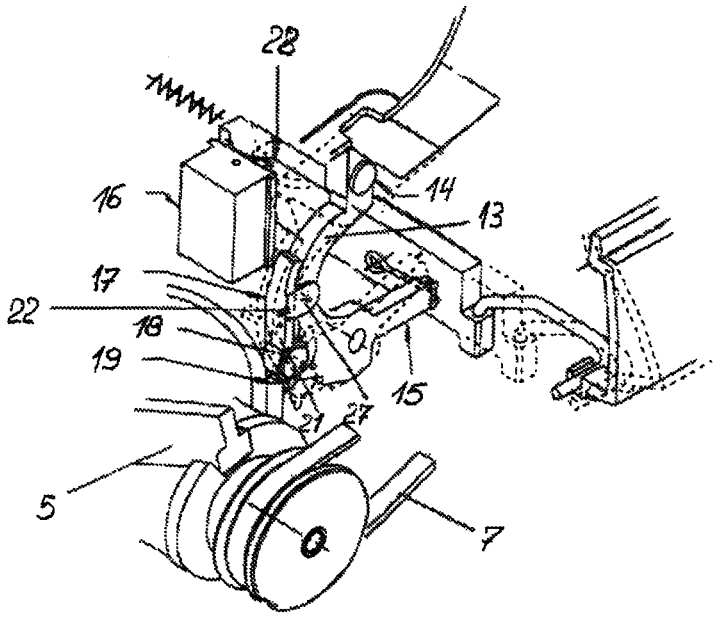
FIG. 4 shows a view of the pivotable lever with locking lever and assignment to the switching element and FIG. 5 shows an enlarged view of the pivotable lever with associated locking lever and FIG. 6 shows a sectional view of a unit for torque detection according to line VI-VI of FIG. 3.
Figure 5:
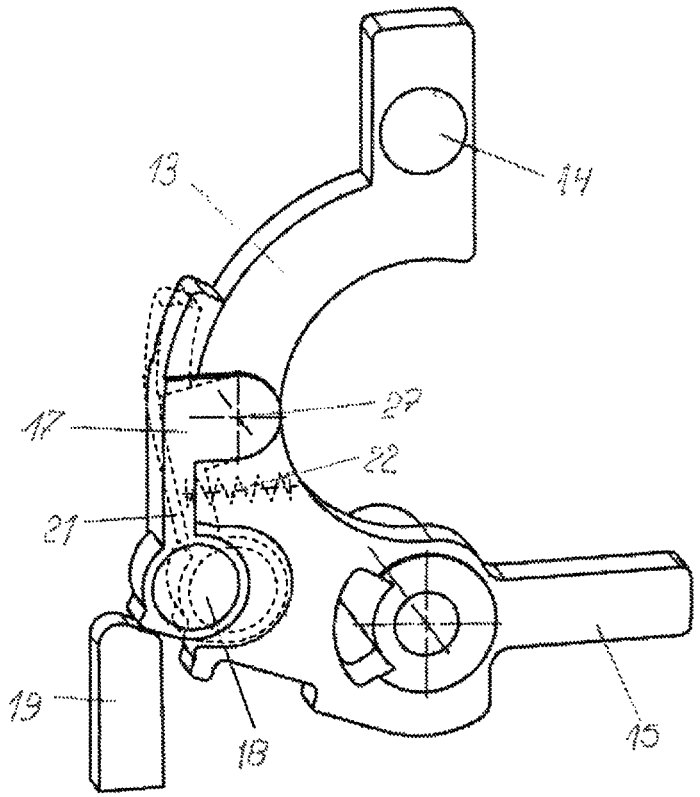
Figure 6:
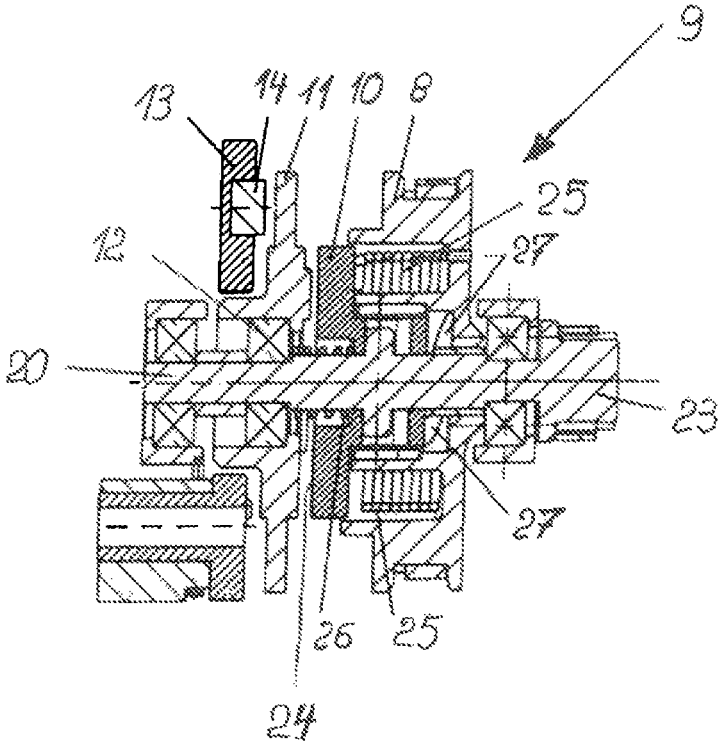

In a brush vacuum cleaner shown, a brush set 1 is connected to an attachable filter housing 2 by means of a pivotable connecting element 3 as connecting piece. The brush set has an electrical drive not shown in detail with a drive pinion 4 for a brush roller 5 via a drive train 6, 7 and at the same time for a suction fan also not shown in detail.

A co-rotating element 8 of a unit 9 for mechanical torque detection is disposed in the drive train 6, 7. In this case, in the event that a torque threshold is exceeded due to overload, a switchable or extendable coupling element 10 as a disk element of the unit 9 for torque detection can be connected to an associated body of rotation as eddy current disk 11. The eddy current disk 11 can be coupled via a bearing 12 concentrically on a shaft 20 to the element 8 and the coupling element 10 of the unit 9 for torque detection via a contact surface 24 as a low-slip connection.

For executing the switching process, a movable support in the form of a fixedly mounted lever 13 is assigned parallel to the eddy current disk 11 which bears a magnet 14 in the external region to form an eddy current. In this case the rotation path of the lever 13 and the plane of rotation of the eddy current disk 11 run approximately parallel.

When the torque threshold is exceeded, the eddy current disk 11 is thus driven via the coupling element 10. In this case, a force is applied to the pivotable lever 13 by the magnetic field formed by the eddy current via the magnet 14 disposed on the lever 13, which lever is thus pivoted and by means of a connected triggering arm 15 via a triggering mechanism 28 actuates a switch 16 for shutting off the drive 4.

In this case, for securing against an unintentional triggering of a switching process, the pivotable lever 13 possesses an additional locking lever 17 which is configured as a two-armed lever via a pivot axis 27. The locking lever 17 is provided with a magnet 18 on the sub-arm 21, which is assigned in a contact-free manner to the eddy current disk 11 where the locking lever 17 on the pivotable lever 13 is pre-stressed by means of a spring element 22 and is disposed with its sub-arm 21 splayed out. In the pre-stressed initial position, the locking lever 17 is held by means of a fixed stop 19 as a lock and blocks the pivotable lever 13. Upon rotation of the eddy current disk 11, an adjustment and a release from the stop 19 takes place by means of the magnetic field formed by the generated eddy current via the magnet 18 of the locking lever 17, so that the lock is released. As a result, the pivotable lever 13 is released and is therefore also pivotable.

In this embodiment, the unit 9 for torque detection incorporated in the drive train 6, 7 is combined with a reducing gear. The shaft 20 has an output 23 to the brush roller 5. Here the element 8 is in this case rotatable as a drive disk and is arranged non-displaceably by means of a bearing on the shaft 20 and is coupled to the coupling element as coupling disk 10 to form a torque detection via a spring 25. At the same time, the coupling disk 10 is coupled to the shaft 20 via cams and is displaceable axially against the force of a spring 26. The connection to the drive 4 between the element as drive disk 8 and the coupling element 10 is made in normal operation via the spring 25, where ribs 27 in the form of a ramp formation above a torque threshold set the coupling element for coupling and for driving the eddy current disk 11 by twisting outwards with respect to the element 8.

Disclosed is a floor care appliance in the form of a brush vacuum cleaner having a brush set facing the floor for receiving a driven brush roller with an overload protection, wherein the brush set has at least one electric motor for a suction fan and for the drive of the brush roller, which is assigned a unit for detecting the torque and a safety shutdown is accomplished by means of a switch arrangement above a torque threshold due to overload, wherein a driven element of the unit for torque detection is disposed in the drive train which above the torque threshold can be coupled by means of a switchable coupling element to an associated body of rotation in the form of an eddy current disk made of electrically conductive material, wherein the eddy current disk is assigned at least one magnet which is pivotably positioned on a fixedly mounted movable support, and an adjustment of the support is made by a magnetic field of the coupled eddy current disk formed by the generated eddy current, wherein the support controls a corresponding circuit arrangement such as a switching element as safety cut-off.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner having a brush set facing the floor for receiving a driven brush roller with an overload protection, comprising:

a pivotable connecting element in the form of a connecting piece connecting the brush set to a filter housing which is attached to a handle in the form of a hand grip via corresponding connections;

the brush set having at least one electric motor for a suction fan and for a drive of the brush roller, a torque detecting unit for detecting a torque of the brush roller;

a switch arrangement configured to generate a safety shutdown above a predetermined torque threshold, due to overload, a driven element of the torque detecting unit being disposed in a drive train of the brush roller which, above the torque threshold, is configured to be coupled by means of a switchable coupling element to an associated body of rotation in the form of an eddy current disk made of electrically conductive material, the eddy current disk containing at least one magnet which is pivotably positioned on a fixedly mounted movable support, an adjustment of the support is made by a magnetic field of the coupled eddy current disk formed by the generated eddy current, and the support being configured to control the switch arrangement as the safety shutdown.

2. The floor care appliance according to claim 1, wherein the switch arrangement is selected from a group consisting of an electrical switch, reed contact, light curtain and mechanical spring-loaded switch.

3. The floor care appliance according to claim 1, wherein the driven element of the torque detecting unit associates the connectable coupling element to the eddy current disk via a contact surface.

4. The floor care appliance according to claim 1, wherein the magnet is disposed on the movable support at a distance from the eddy current disk and the magnetic field lines penetrate the side surfaces of the eddy current disk substantially perpendicularly.

5. The floor care appliance according to claim 1, wherein the magnet cooperates with the eddy current disk in a contact-free manner as a yoke.

6. The floor care appliance according to claim 1, wherein the eddy current disk is disposed concentrically by means of a central bearing for rotation and axial fixing on a shaft with the driven element and the coupling element.

7. The floor care appliance according to claim 1, wherein the movable support is configured as a fixedly mounted pivotable lever, wherein the pivot path of the magnet via the lever runs approximately parallel to a plane of rotation of the eddy current disk.

8. The floor care appliance according to claim 1, wherein the movable support is configured as a fixedly mounted pivotable lever, wherein the pivot path of the magnet via the lever runs approximately at a distance from the external rotation path of the eddy current disk.

9. The floor care appliance according to claim 1, wherein a pivotably arranged locking lever having a magnet cooperates with in a contact-free manner with the eddy current disk on a sub-arm of the locking lever is disposed on the pivotable lever as support, wherein the locking lever is pre-stressed on the pivotable lever by means of a spring element and the sub-arm is splayed out, and the splayed-out sub-arm of the locking lever in the pre-stressed starting position serves as a lock for the pivotable lever by means of a fixed stop, and upon rotation of the eddy current disk by a magnetic field formed by the generated eddy current the locking lever via the magnet releases the locking effect by pivoting.

10. The floor care appliance according to claim 1, wherein the coupling element includes a contact surface configured to be connected to the eddy current disk.

* * * * *